United States Patent [19]

Plath

[11] Patent Number: 5,031,422

[45] Date of Patent: Jul. 16, 1991

[54] METHOD AND CIRCULAR KNITTING MACHINE FOR KNITTING PATTERNED KNITWEAR

[75] Inventor: Ernst-Dieter Plath, Albstadt, Fed. Rep. of Germany

[73] Assignee: SIPRA Patententwicklungs -u.Beteiligungesellschaft mbH, Albstradt, Fed. Rep. of Germany

[21] Appl. No.: 335,818

[22] Filed: Apr. 10, 1989

[30] Foreign Application Priority Data

Apr. 12, 1988 [DE] Fed. Rep. of Germany ..... 3812124

[51] Int. Cl.[5] ..... D04B 9/42

[52] U.S. Cl. ..... 66/145 S

[58] Field of Search ..... 66/145 S, 145 R; 26/11, 26/15 R

[56] References Cited

U.S. PATENT DOCUMENTS

| | | | |
|---|---|---|---|
| 2,810,280 | 10/1957 | Rossman | 66/145 S |
| 2,824,436 | 2/1958 | Stack et al. | 66/145 S |
| 2,989,935 | 6/1961 | Butler | 66/145 S |
| 3,050,970 | 8/1962 | Billi | 66/145 S |
| 3,222,892 | 12/1965 | Moyer | 66/145 S |
| 3,279,023 | 10/1966 | Zobei | 26/11 |
| 3,333,498 | 8/1967 | Holm | 26/15 R |
| 3,572,059 | 3/1971 | Goadby | 66/145 S |
| 3,714,799 | 2/1973 | Minton | 66/145 S |

FOREIGN PATENT DOCUMENTS

| | | |
|---|---|---|
| 0135289 | 3/1985 | European Pat. Off. . |
| 136746 | 12/1919 | United Kingdom . |
| 915016 | 1/1963 | United Kingdom . |
| 1077262 | 7/1967 | United Kingdom . |
| 1333766 | 10/1973 | United Kingdom . |

*Primary Examiner*—Werner H. Schroeder
*Assistant Examiner*—John J. Calvert

[57] ABSTRACT

The invention relates to a circular knitting machine and a method carried out thereon for kniting patterned knitwear with a plurality of yarns. So that it is also possible to make patterns in which any yarns (25) are not worked by a plurality of adjacent needles (12), the floats (26) resulting therefrom are parted from inside the needle circle (10*a*) and the yarn ends (28) thereby resulting on the side of the associated yarn guide (24) are constantly retained in the capture region of the needles (12) selectable by the selector device for yarn reception. The patterning can thus be effected solely with the aid of the selector devices. Yarn change devices or ring guide bars are not needed (FIG. 2).

11 Claims, 4 Drawing Sheets

METHOD AND CIRCULAR KNITTING MACHINE FOR KNITTING PATTERNED KNITWEAR

Figure 1:
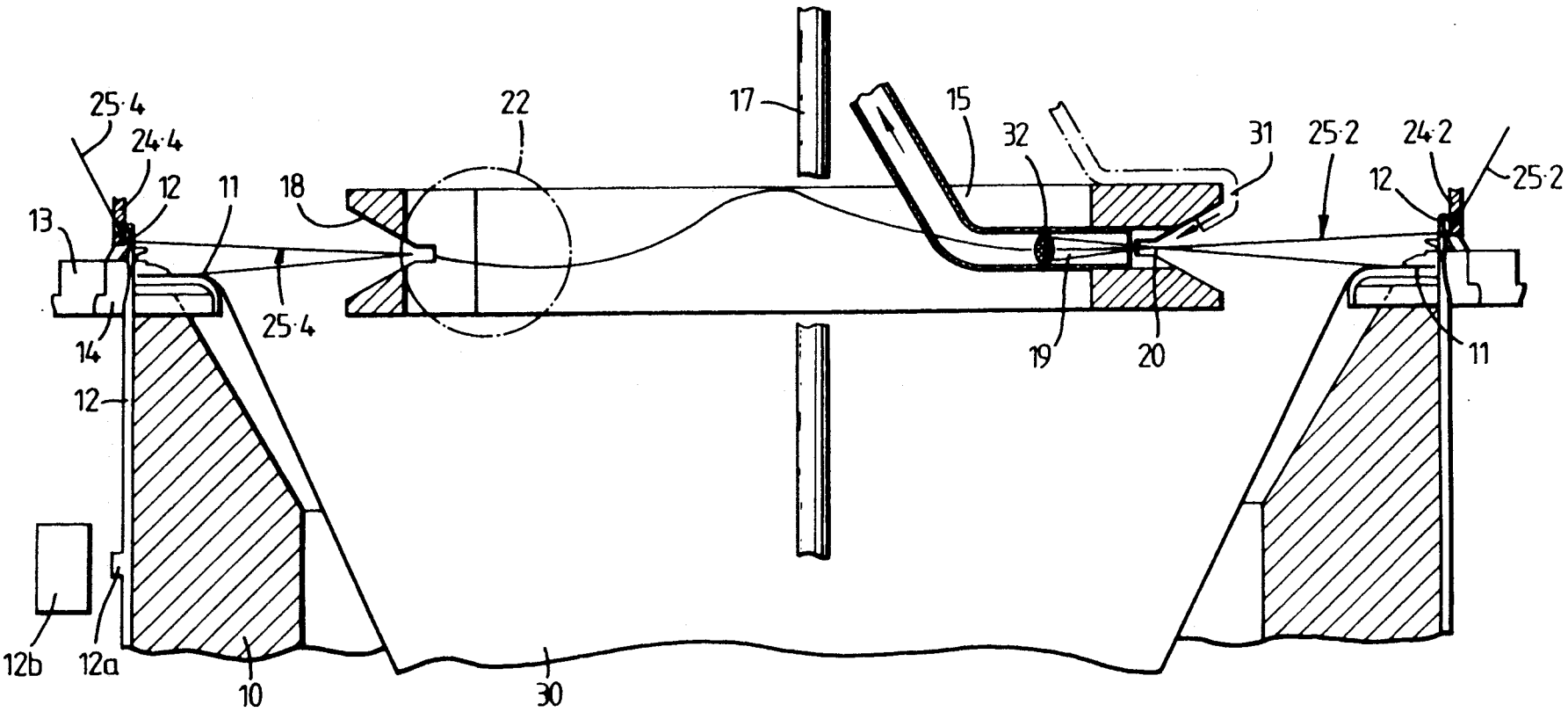

This invention relates to a method and a circular knitting machine for knitting patterned knitwear corresponding to the introductory parts of claims 1 and 3.

Numerous methods and circular knitting machines are known for making patterned knitwear. In the manufacture of so-called Jacquard patterns on circular knitting machines with only one needle carrier, the coloured yarns appear on the right side of the material as loops and on the back side as floats. If it is a pattern with very long floats, then these can be caught in, e.g. as caught loops (DE-OS 3 135 702) but they cause a large usage of yarn. A correspondingly greater yarn usage arises with the use of circular knitting machines with two needle carriers, e.g. comprising cylinder and dial needles, in which the problem of long floats is avoided in that the yarns are worked by the dial needles with formation of a specially formed material reverse side. Furthermore circular knitting machines are known which are provided on one or all systems with yarn change devices or ring guide bars. These consist of a plurality of switchable inserting organs, which each introduce another kind of yarn. The pattern is obtained in that, in the region of a change device, all knitting needles are selected for yarn reception and the yarn of an inserting organ switched in according to the pattern is introduced. A colour change or the like can then take place in that the relevant inserting organ is switched out and another inserting organ is switched in. In order that the yarns fed by each switched out insertion organ shall be removed with certainty from the capture region of the knitting needles, this yarn is parted with a parting device associated with the change device, whereby there results a yarn end hanging from the knitwear, i.e. associated therewith, and one associated with the yarn guide or a yarn end which hangs on the yarn fed from this insertion organ. In order that this yarn end will with certainty be in the capture region of the knitting needles again on the next switching in of the insertion organ, the parting device is also provided with a retaining organ, which can consist of a yarn clip, a suction nozzle or the like. Change devices of this kind are not only expensive but are poorly suited to rapidly running circular knitting machines, because relatively long intervals of time are needed for the switching in and out of the insertion organs. Moreover the change between two yarns cannot take place at a selected needle but always only within a group of neighbouring needles.

The invention is based on the problem of providing a method and a circular knitting machine with which patterned knitwear can be produced from a plurality of yarns in simple manner and with small constructional expense. In this the use of yarn change devices is in particular to be avoided. Moreover it is to be avoided that undesirably long floats arise or special measures have to be employed in order to bind the floats into the knitwear, because both of these involve high yarn usage.

Starting out from the initially indicated method and the initially indicated circular knitting machine, the characterizing features of claims 1 and 3 serve to solve this problem.

The method according to the invention above all permits the use of all circular knitting machines with only one needle carrier, i.e. so-called single machines or machines for the production of left/right knitwear. Such a circular knitting machine merely needs a plurality of positionally fixed yarn guides with no switchable parts, an arbitrary device for selection of the knitting needles according to the pattern and a cutting device for cutting the floats. Arbitrary patterns, especially Jacquard patterns and mesh patterns can thereby be realised, with the particular advantage that the floats never exceed a predetermined length. The yarn ends resulting from cutting the floats, connected to the knitwear, can be shortened to a length adapted to the requirements of the individual case with the aid of a shearing machine or the like, in a method following the knitting process. Apart from this, the method according to the invention can also be used on circular knitting machines for the production of plush goods or the like (e.g. DE-OS 3 145 307), in which all needles at each system work a ground yarn and a selected one of a plurality of possible plush yarns. In this case the floats of the plush yarns are cut on reaching a predetermined length.

Figure 2:
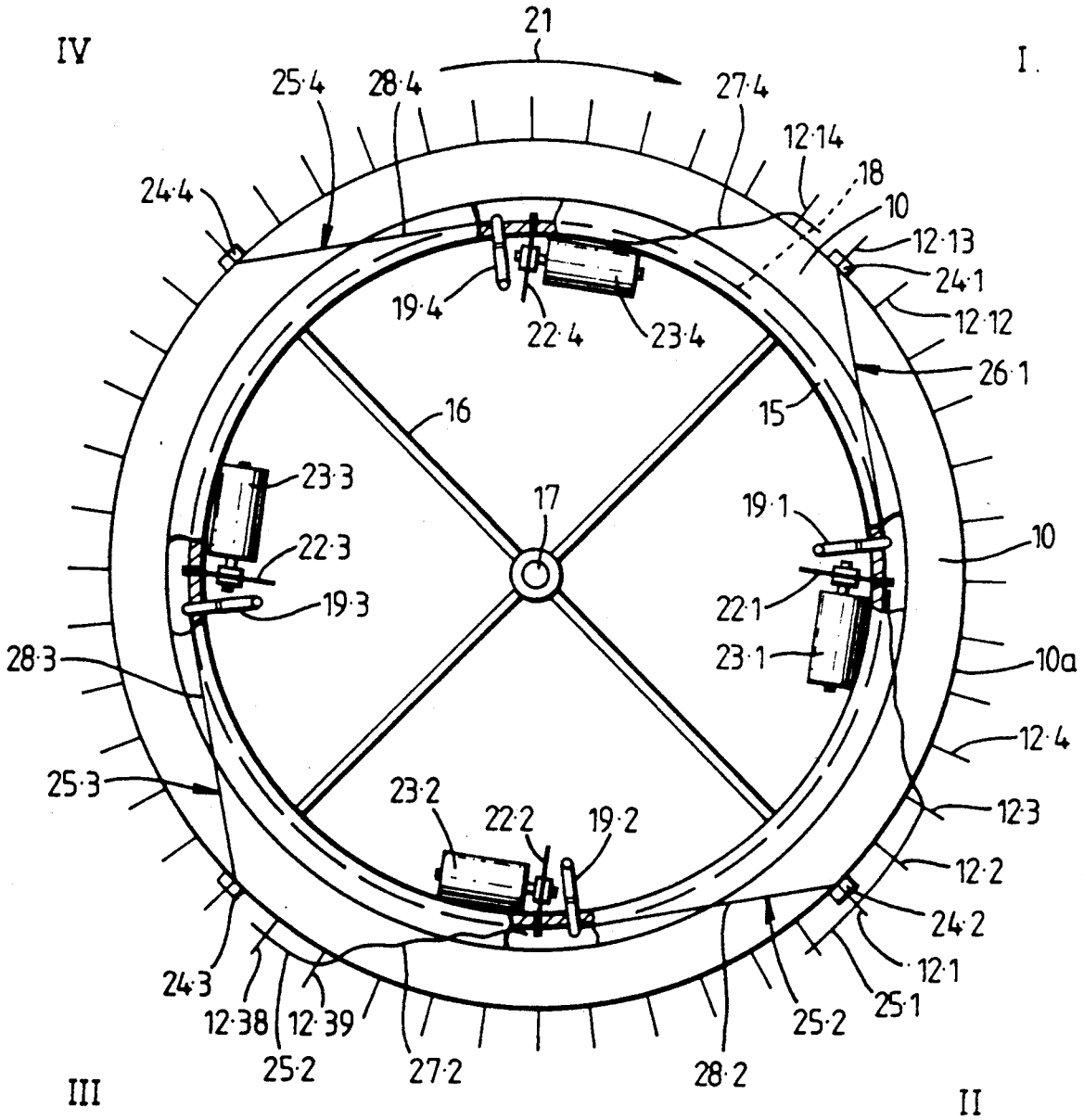
Figure 3:
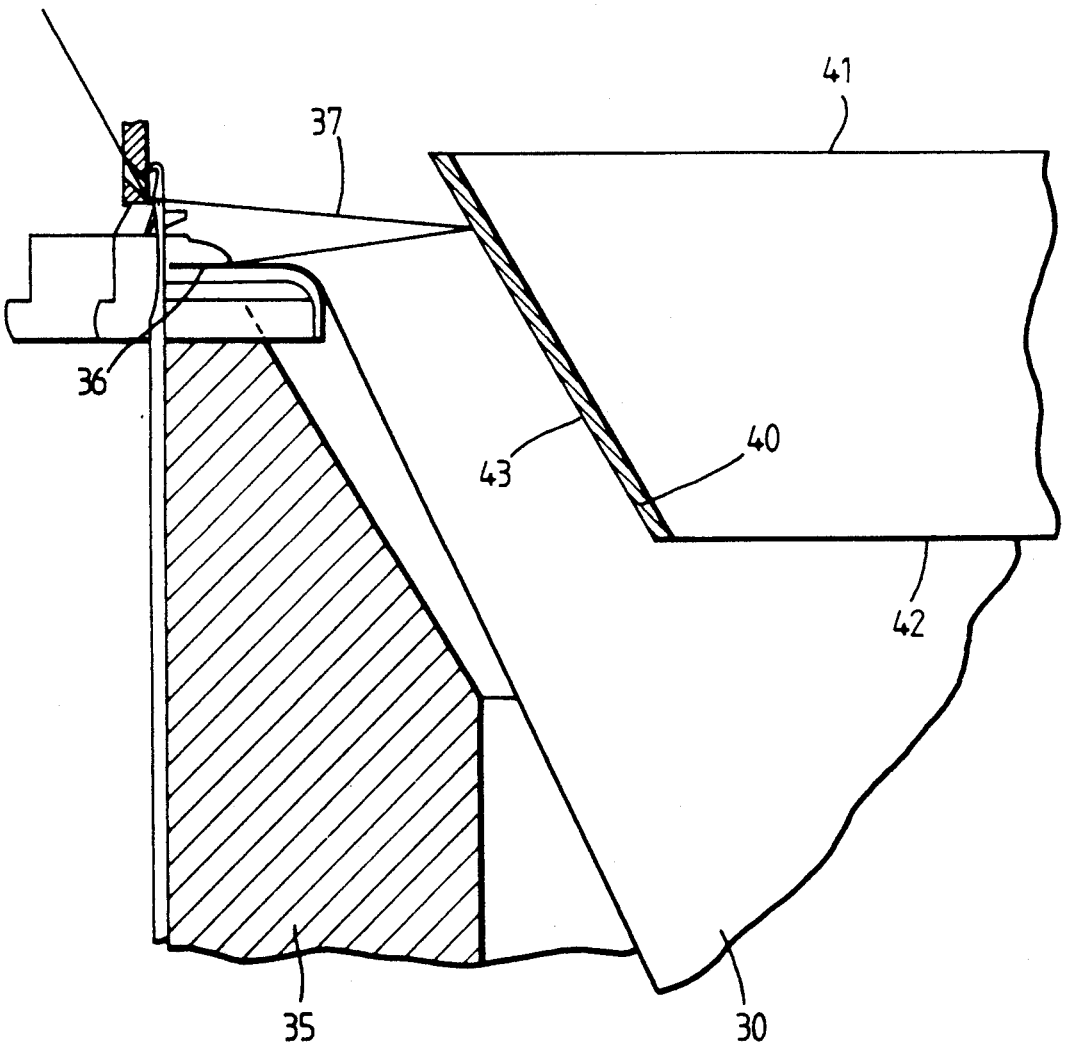
Figure 4:
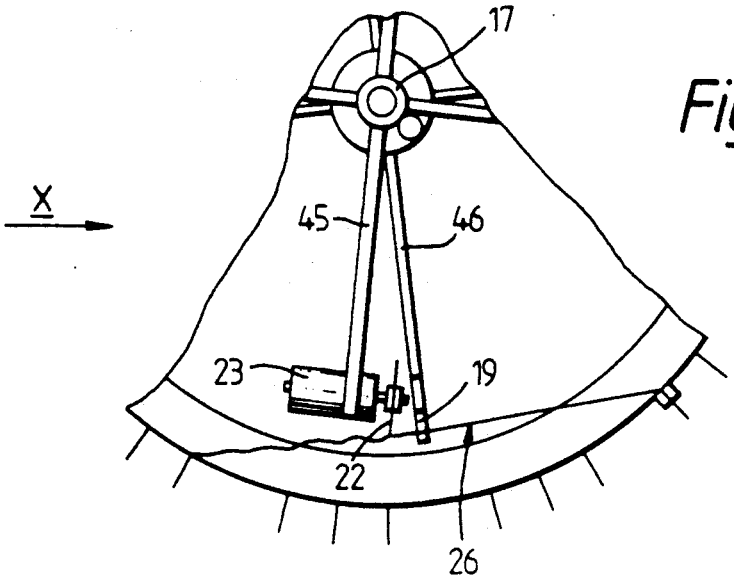
Figure 5:
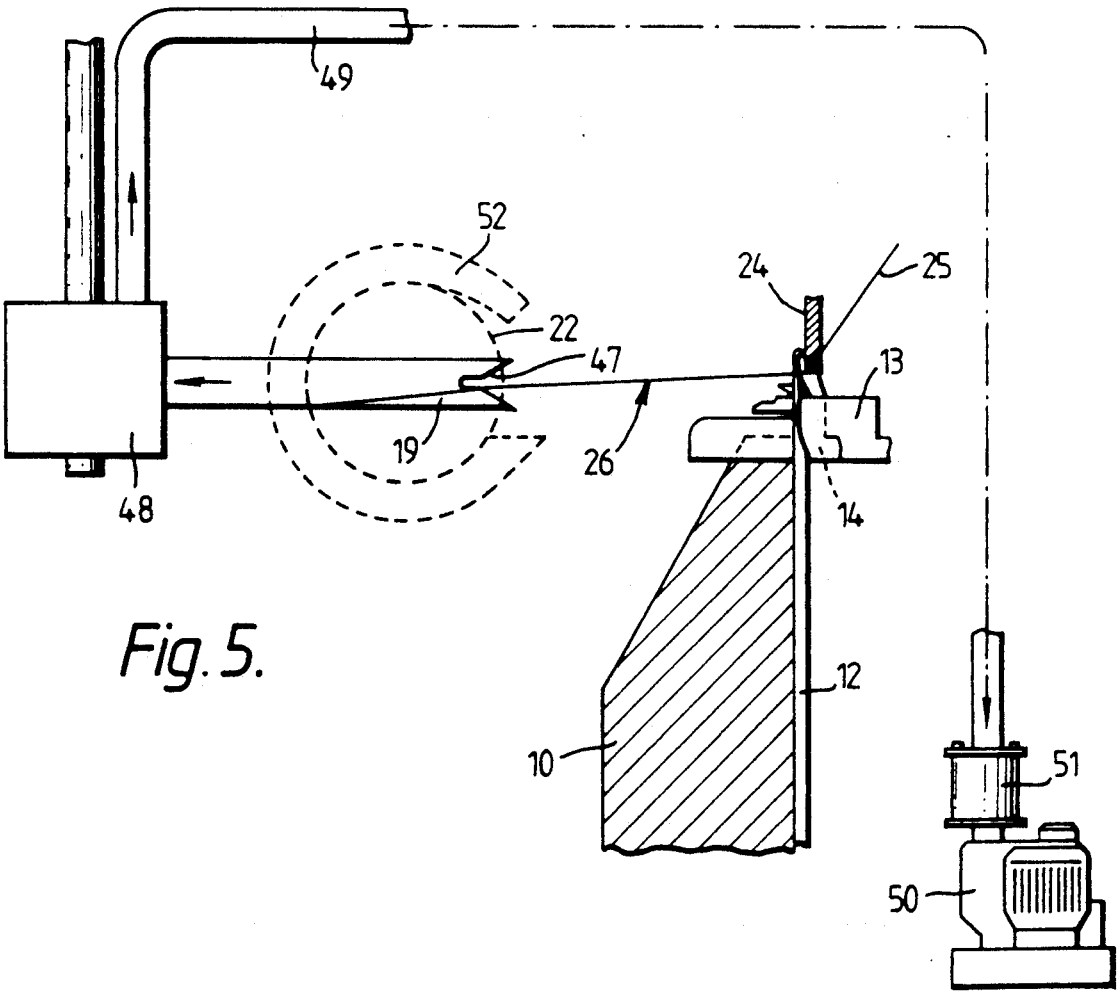

The invention will be explained below in conjunction with the accompanying drawings of embodiments. These show:

FIG. 1 a schematic longitudinal section through a circular knitting machine according to the invention;

FIG. 2 a schematic plan view of the circular knitting machine according to FIG. 1 to a reduced scale;

FIG. 3 a partial section similar to FIG. 1 through a further embodiment of the circular knitting machine;

FIG. 4 a schematic, partial plan view similar to FIG. 2 of a third embodiment of the invention; and FIG. 5 a part section corresponding to FIG. 3 through the circular knitting machine according to FIG. 4 in enlarged scale.

In FIG. 1 there is shown from a circular knitting machine only the upper edge of a needle carrier 10 in the form of a needle cylinder with a knock-over edge 11. The circular knitting machine in question can be as is described in DE-OS 3 145 307 and in which the needle carrier 10 is mounted rotatably in a base frame as a sinker ring, not shown. A plurality of knitting needles 12 are mounted movably in the needle carrier 10 on a needle circle 10*a* seen in FIG. 2 and cooperate with sinkers 13 and 14 (FIG. 1). The needles 12 are shown simply by strokes in FIG. 2.

They comprise conventional butts 12*a* (FIG. 1), with which are associated a selector device 12*b* and lock parts, not shown, which are both arranged stationary at the periphery of the needle carrier 10. The selection device, not shown here in more detail can be in particular a freely controllable and programmable electromagnetic selection device or any other known Jacquard or lock-switching device. A particularly advantageous selector device is known for example from DE-OS 1 585 211.

At the height of the knock-over edge 11 there is a stationary ring 15 inside the needle carrier 10 or needle circle 10*a*, which ring is fixed to a central support 17 by struts 16 and extends in the loop-forming plane. The ring 15 has a wedge-shaped outer groove 18, which forms a guide organ with a wedge gap for the reception of floats. On the inside of the ring 15 there are arranged four retaining organs in the form of suction nozzles 19.1 to 19.4, which are distributed uniformly around the circumference of the ring 15 and each end in a circular opening 20 extending into the outer groove 18. The suction nozzles 19 are connected in a manner not shown to a vacuum source. Beside each suction nozzle 19, behind each suction nozzle 19 in the direction of rotation (arrow 21 in FIG. 2), there is arranged a cutting or parting device having a cutting element in the form of a cutting disc 22.1 to 22.4, which are each driven by a small electric motor 23.1 to 23.4. Each suction nozzle 19 forms a parting device with its associated cutting disc 22.

At the periphery of the needle carrier 10 and outside the needle circle 10*a* there are arranged alongside the loop-forming region four equally spaced yarn guides 24.1 to 24.4, which are only shown schematically in the drawings and of which each feeds a different yarn 25.1 to 25.4, for example a yarn of different colour. The yarns 25 are fed by the yarn guides 24 to the knitting needles 12 of the needle carrier 10. This means that the yarn guides 24 are so arranged that the yarns are engaged by pattern-selected needles 12, whereas non-selected needles 12 pass without receiving the yarn 25. To this end, the selector device 12*b* at each knitting system I to IV (FIG. 2) of the circular knitting machine, i.e. at each yarn guide 24, has corresponding selector elements which, with the aid of associated lock parts, raise the selected needles 12 for example to a position adapted to receive yarn (FIG. 1) or leave them in a miss position not adapted to receive yarn. Naturally the control could also take place conversely and those needles which are not to receive yarn be controlled from a raised position into the miss position. The details of such selector devices are commonly known to the man in the art and need not be explained here in more detail.

The selected needles 12 are withdrawn after the yarn reception to a position in which they form a loop with the received yarn 25 or are coupled in special manner with knitwear 30 shown in FIG. 1. This is indicated in FIG. 2 by way of example for needles 12.1, 12.3 and 12.3, which have received the yarn 25.1 in system I and worked it to a loop. If on the other hand the needles 12 at any system I to IV have not been selected for yarn reception, then the corresponding yarn 25 is not engaged by these needles but passes and is worked as a float 26.1, 26.2, etc. This is indicated in FIG. 2 by way of example for needles 12.4 to 12.12 and a float 26.1 of the yarn 25.1 created thereby. The float 26.1 thus lies along a chord of the needle circle 10*a*, this chord extending from the respective last needle (e.g. 12.3) which has received the yarn (here 25.1), up to the first needle (here 12.13) which first again receives the yarn (here 25.1) after an arbitrary number of non-selected needles (here 12.4 to 12.12).

The parting devices are so arranged within the needle circle 10*a* that their cutting blades 22 come into contact with the floats 26 as soon as these have a certain length, as is indicated in FIG. 2 by way of example for the float 26.1. This float is thus parted and there result a yarn end 27 connected to the knitwear 30 and a yarn end 28 connected to the yarn 25 coming from the yarn guide 24. The yarn ends 27 (e.g. 27.2 in FIG. 2) are referred to in general below as "the yarn ends associated with the knitwear" and the yarn ends 28 as "the yarn ends associated with the yarn guides".

The parting devices are moreover so arranged within the needle circle 10*a* that the floats 26 have entered the wedge-shaped outer groove 18 at the latest on attaining the preselected length and thereby come into the zone of action of the corresponding suction nozzle 19. This has the consequence that the yarn ends 28 associated with the yarn guides 24 are sucked in by the suction nozzles 19 and are held taut between these and the associated yarn guides, so that they assume a position crossing the needle circle 10*a* and thereby stay in the engagement region of the selected needles 12 associated with the respective yarn guide. Thus, for example, if the needle 12.4 is a needle which is selected to receive in the system II, then this needle 12.4 can engage the yarn end 28.2, in order to from a loop. The yarn end 28.2 cannot be engaged by a non-selected needle in the system II. On the other hand the yarn ends (e.g. 27.2) associated with the needles can, on further rotation of the needle carrier 10, be gradually withdrawn from the associated suction nozzle (19.2 in FIG. 2) by the associated needles (e.g. 12.38, 12.39 in FIG. 2). They then lie on the knitwear 30 bearing on the knock-over edge 11, without affecting the further knitting operation, and can later be shortened by means of a shearing machine.

In system III of FIG. 2 it is shown that the associated yarn 25.3 has been cut, so that its yarn end 28.3 is controlled by the suction nozzle 19.3. The corresponding yarn end 27 associated with the knitwear is no longer visible, e.g. because the needle carrier 10 has made a plurality of revolutions without the yarn 25.3 being received by any needles. Finally, in system IV are shown a yarn end 28.4 controlled by the suction nozzle 19.4 and a yarn end 27.4 which has already removed from the suction nozzle 19.4, since it is under the influence of a needle 12.4.

In the described manner, multitudinous patterns can be produced using a single, stationary yarn guide at each knitting system I to IV. In this a yarn change can take place at any arbitrary needle, in that this needle is selected to receive yarn by means of the selector device. Short floats, whose length corresponds at most to the value established by the position of the cutting blade 22, thus appear on the back of the knitwear 30 while, on the appearance of longer floats, the described cutting and suction operation automatically takes place. Accordingly it is possible, without any further measures, to drive hardly any needles for yarn reception over several revolutions of the needle carrier 10 or to produce patterns which comprise the yarn of one colour over a zone extending over practically the whole circumference of the needle carrier and the yarn of another colour only over a zone extending over a few needles.

If it is desired to connect together firmly pattern zones of different colours, those needles which are associated with the transition regions (changeover points) between the pattern zones, are preferably fed with both participating yarns. Such transition regions can extend over very few needles, e.g. two.

In order that the yarn ends are not sucked into the suction nozzles 19, so that further yarn is drawn off the yarn guides 24, each suction nozzle 19 is provided with a screen 32 in the form of a sieve insert or the like. Such screens can be dispensed with if the yarn tension is greater than the suction force.

Instead of suction nozzles 19, blower nozzles 31 could also be arranged on the ring 15, as is indicated on the right hand side of FIG. 1. They blow the yarn 25 into the circular opening 20. Instead of an individual circular opening 20, a plurality of bores could be formed alongside each other, into which the yarn dips in wave-form. Suction and blowing nozzles can also be fitted in combination.

FIG. 3 shows a modified embodiment in which the ring 15 is replaced by an elongated, tubular ring 40, whose diameter decreases from its upper edge 41 projecting beyond a loop knock-over edge 36 of a needle cylinder 35 to its lower edge 42. The ring 40 is held in fixed position on the central support 17 (FIG. 2). The floats 37 lying on chords of the needle circle are again, after touching the ring 40, cut by a cutting organ, not shown, and the yarn end associated with the yarn guide is retained by a retaining organ, likewise not shown, while the yarn ends associated with the knitwear 30 are deflected downwardly along an inclined outer face 43 of the tube 40. This prevents the possibility of the free yarn ends getting up into the knitting region of the machine and of the yarn floats tangling in the centre or winding on the support 17.

The embodiment according to FIG. 3 can, like the embodiment according to FIGS. 1 and 2, be used also without air nozzles 19. In this advantage is taken of the fact that the yarn ends 28 associated with the yarn guides lie in similar fashion on the knitwear after the cutting operation, as is shown in FIG. 2 for the yarn end 28.4 associated with the yarn guide 24.4. Since the knitwear rotates together with the needle carrier 10 in the direction of the arrow 21, while the yarn and the corresponding yarn guide is stationary, the yarn end 28 is also held taut by the friction between the knitwear and the yarn and so that it crosses the needle circle 10*a* and will thus be engaged by the next selected needle. However the additional use of the air nozzles 19 avoids in advantageous manner the yarn ends 28 springing back in the direction of the associated yarn guide after the cutting operation, under the yarn tension provided in customary manner, and thereby possibly laying undesirably in selected needles.

The embodiment according to FIGS. 4 and 5, whereof the latter shows a view in the direction of the arrow x of FIG. 4, is identical in substance with the embodiment according to FIGS. 1 and 2. Accordingly like parts are given the same reference numberals. The parting devices are here not fixed to a common ring 15 but on individual struts 45, 46, which are fixed on the central support 17 in radiating arrangement. Thus the struts 45 carry the cutting blades 22 and motors 23, whereas the struts 46 carry the air nozzles 19; the struts 45, 46 could also be connected by circumferential ring structures, not extending to the knock-over edge of the needle carrier 10. Since with omission of the ring 15 the wedge-shaped outer groove 18 is also missing, the air nozzles 19 are each provided themselves with a wedge gap 47 serving for yarn reception of the floats 26. Instead of the wedge gap 47, other guide organs could be provided. All suction nozzles 19 open into a common connecting head 48, from which a suction line 49 leads out to a suction unit 50. The airstream is indicated by arrows. Cut yarn sections and slubs are collected in a collecting chamber 51, which is provided with a sieve insert. The cutting blades 22 are formed as rotating cutting discs and are each provided with a guard ring 52.

The invention is not restricted to the described embodiments, which can be modified in numerous ways. The yarns 25 can for example be the ground yarns of RL-knitwear or plush or other yarns, in which case each needle 12 can be fed additionally with a yarn serving as ground yarn in a manner which is known and therefore not shown. In this it is conceivable to use instead of the illustrated latch needles also other needles, e.g. compound needles or merely hooked needles. Furthermore it is immaterial whether the needles are controlled after the reception of the yarn 25 immediately to a knitting position or firstly to an intermediate position. A realisation is also conceivable in which the needle carrier 10 is stationary and the change devices, lock parts, yarn guides, etc. are formed rotating instead. Other cutting elements, e.g. heated wires, can be used instead of the cutting blades 22 for parting the floats. Finally it is possible to replace the air nozzles 19 by other retaining organs. The use e.g. of sprung jaws bearing on one another is conceivable, which are formed similarly to the wedge gap 47 and between which the floats 26 are automatically introduced with the rotation of the needle carrier 10. In this case the yarn ends associated with the yarn guides are retained by friction or clamping.

On the basis of the described embodiments, each yarn 25 is always located in accordance with the invention in a capture region for the associated needles, and moreover independent of whether the yarn is still connected to the knitwear, because a number of selected needles have received and worked the yarn, or whether the yarn is no longer connected to the knitwear but is retained with its end 28 by the retaining organ 19 or lies on the knitwear 30 itself. Thus swinging insertion organs, switched yarn guides or the like are superfluous and the patterning can take place solely with the use of conventional selector devices. With the use of a rotating needle carrier 10 it can be accurately determined by the spatial position of the parting devices, which are in this case arranged stationary like the yarn guides, how long the individual yarn ends 27 or 28 shall be. With a larger number of knitting systems it is finally possible to associate a plurality of yarn guides with one common parting device or to proved one yarn guide and an associated parting device per system.

I claim:

1. A method for fabricating a knitted fabric and for producing a pattern therein with a plurality of yarns of different kinds on a circular knitting machine having a needle carrier, a plurality of knitting needles movably mounted on said needle carrier and arranged along a needle circle, a plurality of yarn guides for feeding one of said yarns each, said yarn guides being arranged along said needle carrier and outside of said needle circle and being mutually spaced from each other, and a plurality of means arranged along said needle carrier for controlling, at each of said yarn guides, first needles such that they receive a yarn from said yarn guides and bind said yarn into the fabric and for also controlling second needles such that the same are unable to receive a yarn at said yarn guides but let the yarn float; said method comprising the steps of: knitting said fabric with said needles from said yarns; selecting said first and second needles at each of said yarn guides in accordance with said pattern; parting the floats of said yarns, when said floats attain a predetermined length, inside said needle circle into first yarn ends being connected to the fabric and second yarn ends being connected to one of said yarn guides such that said second yarn ends are in a position crossing said needle circle; retaining said second yarn ends without actuation of said yarn guides in said needle circle crossing positions such that the same are adapted to be received by said first needles but are unable to be received by said second needles; and retaining said second yarn ends in said positions at least long enough to be received by a selected needle and bound into said fabric.

2. A method according to claim 1, wherein the yarn ends associated with the knitwear are shortened by a shearing operation upon conclusion of knitting the knitwear.

3. A circular knitting machine for fabricating a knitted fabric and for producing a pattern therein with a plurality of yarns of different kinds, comprising: a needle carrier; a plurality of knitting needles movably mounted on said needle carrier and arranged along a needle circle; a plurality of yarn guides for feeding one of said yarns each, said yarn guides being arranged along and outside of said needle circle and being mutually spaced from each other; a plurality of means arranged along said needle carrier for controlling, at each of said yarn guides, first needles such that they receive a yarn from said yarn guides and bind said yarn into the fabric and also for controlling second needles such that the latter are unable to receive a yarn at said yarn guides but let the yarn float; means for selecting said first and said second needles for each of said yarn guides in accordance with said pattern; at least one parting device arranged inside said needle circle for parting said floats of at least one of said yarns, when said floats attain a predetermined length, inside said needle circle into first yarn ends associated with the fabric and second yarn ends being connected to one of said yarn guides such that said second yarn ends are in a position crossing said needle circle, said parting device being assigned to a predetermined chord of said needle circle such that the floats are parted on attaining a length corresponding to said chord and that said second ends formed thereby are retained in a position crossing said needle circle such that the same are adapted to be received by said first needles but are unable to be received by said second needles.

4. A circular knitting machine according to claim 3, wherein each parting device comprises a retaining organ for the yarn end associated with the yarn guide.

5. A circular knitting machine according to claim 4, wherein the retaining organ consists of an air nozzle.

6. A circular knitting machine according to any one of claims 3 to 5, wherein a plurality of said parting devices are distributed along the needle circle.

7. A circular knitting machine according to claim 6, wherein each yarn guide has a parting device associated therewith.

8. A circular knitting machine according to claim 5, wherein the air nozzle is associated with a guide organ with a wedge gap for receiving the floats.

9. A circular knitting machine according to claim 8, comprising a screen associated with the air nozzle, for preventing entry of yarn.

10. A circular knitting machine according to claim 6, wherein all parting devices are fixed to a common support.

11. A circular knitting machine according to claim 7, wherein all parting devices are fixed to a common support.

* * * * *